US007395928B2

(12) United States Patent
Bertsch et al.

(10) Patent No.: US 7,395,928 B2
(45) Date of Patent: Jul. 8, 2008

(54) CHILD-RESISTANT BLISTER PACKAGE

(75) Inventors: Shane Kenneth Bertsch, Chicago, IL (US); Steven E. Breitenstein, Palatine, IL (US)

(73) Assignee: Abbott Laboratories, Abbott Park, IL (US)

( * ) Notice: Subject to any disclaimer, the term of this patent is extended or adjusted under 35 U.S.C. 154(b) by 245 days.

(21) Appl. No.: 11/181,515

(22) Filed: Jul. 14, 2005

(65) Prior Publication Data

US 2007/0012592 A1 Jan. 18, 2007

(51) Int. Cl.
*B65D 83/04* (2006.01)

(52) U.S. Cl. ..... 206/531; 206/528; 206/532

(58) Field of Classification Search ..... 206/469, 206/528, 530, 531, 532, 534, 534.1, 539, 206/484, 538
See application file for complete search history.

(56) References Cited

U.S. PATENT DOCUMENTS 3,809,220 A * 5/1974 Arcudi ..... 206/484
3,941,248 A * 3/1976 Moser et al. ..... 206/531
4,196,809 A * 4/1980 Tonrey ..... 206/534
4,398,634 A * 8/1983 McClosky ..... 206/532
4,673,086 A * 6/1987 Braverman et al. ..... 206/538
5,325,968 A * 7/1994 Sowden ..... 206/532
5,393,032 A * 2/1995 Cederroth ..... 249/61
5,775,505 A 7/1998 Vasquez et al.
5,873,483 A * 2/1999 Gortz et al. ..... 220/269
5,878,888 A * 3/1999 Faughey et al. ..... 206/530
5,894,930 A * 4/1999 Faughey et al. ..... 206/532
5,944,191 A * 8/1999 Ray et al. ..... 206/532
6,155,423 A * 12/2000 Katzner et al. ..... 206/531
6,516,949 B2 * 2/2003 Fuller et al. ..... 206/530
6,830,153 B2 * 12/2004 French et al. ..... 206/538
2002/0008046 A1 1/2002 Fuller et al.
2006/0138016 A1 * 6/2006 Harper ..... 206/532

* cited by examiner

*Primary Examiner*—David T Fidei
(74) *Attorney, Agent, or Firm*—B. Gregory Donner

(57) ABSTRACT

A child-resistant blister card package is disclosed having a plurality of unit package regions for enclosing one unit dosage form, each comprising a cavity and a closure sheet to seal the cavity. Once a unit package region is detached, the corner defined by lines of weakening with perforations can be detached to expose an unsealed area and easily access the content of each unit package region.

7 Claims, 2 Drawing Sheets

CHILD-RESISTANT BLISTER PACKAGE

FIELD OF THE INVENTION

The present invention relates to a package for unit-dosage drug formulations, which is lightweight, child-resistant and user friendly.

BACKGROUND OF THE INVENTION

Blister card packages are commonly used to enclose and store individual dosage forms for the consumer. Ideally, these packages must be easy to use for adults, protective for the product and difficult for children to open. Typically, the card package consists of a top sheet (or container sheet), which has integrally-formed blisters or cavities designed to hold the contents, for example pharmaceutical dosage forms. The top sheet is sealed around the periphery of each blister unit to a closure sheet (or lidding), which normally consists of a multi-layered laminate foil. In some blister card packages the dosage is accessed by pressing it through the closure sheet, where the closure sheet is made of a rupturable material. In other card packages, the closure sheet is peeled off from the top sheet to release the blister contents. Prior art blister card packages also provide for packages with perforations between separable blister units and unsealed areas between the container sheet and the closure sheet. The perforations provide for a line of weakening which allows the card to bend along the line of weakening and separate each individual blister unit. Usually, the individual unit must be removed to have access to the blister content. U.S. Pat. No. 5,046,618 discloses a child-resistant blister package wherein each individual package is defined by lines of weakening terminating short of the edge of the blister package and is provided with a tear strip defined by an additional line of weakening. After removal of the tear strip an unsealed corner region is exposed, which can be grasped and pulled allowing the separation of the closure sheet from the container sheet and the access to the formulation dosage. U.S. Pat. No. 5,557,505 discloses a blister card package with cut out areas exposing an area of the closure sheet at the intersection of the lines of weakening. After detachment of one individual dosage blister the area of exposed closure sheet forms a finger tab that when pulled separates the closure sheet from the container sheet allowing access to the content of the blister cavity.

The present invention was developed to provide a blister card package that is child-resistant and that can be easily opened by an instructed adult who is able to follow the instructions. The present invention includes easy to access pull tabs and no interruptions in the container sheet to ensure protection of the contents.

SUMMARY OF THE INVENTION

In its principal embodiment, the present invention comprises a child-resistant blister pack defining a plurality of unit package regions wherein each region encloses one unit dosage form. Said blister pack comprises a blister film sheet having unit package regions, wherein each unit package region consists of a cavity and a flange surrounding the cavity, each cavity being adapted to receive a unit dosage form, and a lidding sheet sealed to the flanges of the blister film sheet for enclosing a unit dosage form within each unit package region. The blister pack of the present invention comprises a first set of lines of weakness extending from side to side and terminating at the edge of the blister pack, and second set of lines of weakness extending from side to side and terminating at the edge of the blister pack and intersecting with the first lines of weakness, in which said first and second set of lines of weakness define the inner borders of each unit package region. The blister pack of the present invention further comprises a third set of lines of weakness at the internal corner of each unit package region, defining an unsealed area along each of said line of weakness, and an area of sealed blister sheet and lidding sheet at the internal corner of each unit package region. After an individual unit package region is separated, an unsealed area between the blister sheet and lidding sheet is exposed when the third line of weakness is bent, to form a large enough pull tab to easily detach the lidding sheet.

BRIEF DESCRIPTION OF THE DRAWINGS

FIG. 1(*b*) is a cross section view of the blister card package from point A' to A of FIG. 1(*a*).

FIG. 2(*b*) is a cross section view of the unit package regions of FIG. 2(*a*).

FIG. 2(*c*) is a cross-sectional view of the unit package region of FIG. 2(*a*) in which the third line of weakness of the inner corner is bent.

FIG. 2(*d*) is also a cross-sectional view the unit package regions of FIG. 2(*a*), in which the unsealed area is exposed and the closure or lidding sheet can be used as a pull tab to detach the closure sheet from the container sheet.

DETAILED DESCRIPTION OF THE INVENTION

The primary object of the present invention is to provide a blister package that is child resistant and has a senior friendly opening feature.

Figure 1A:
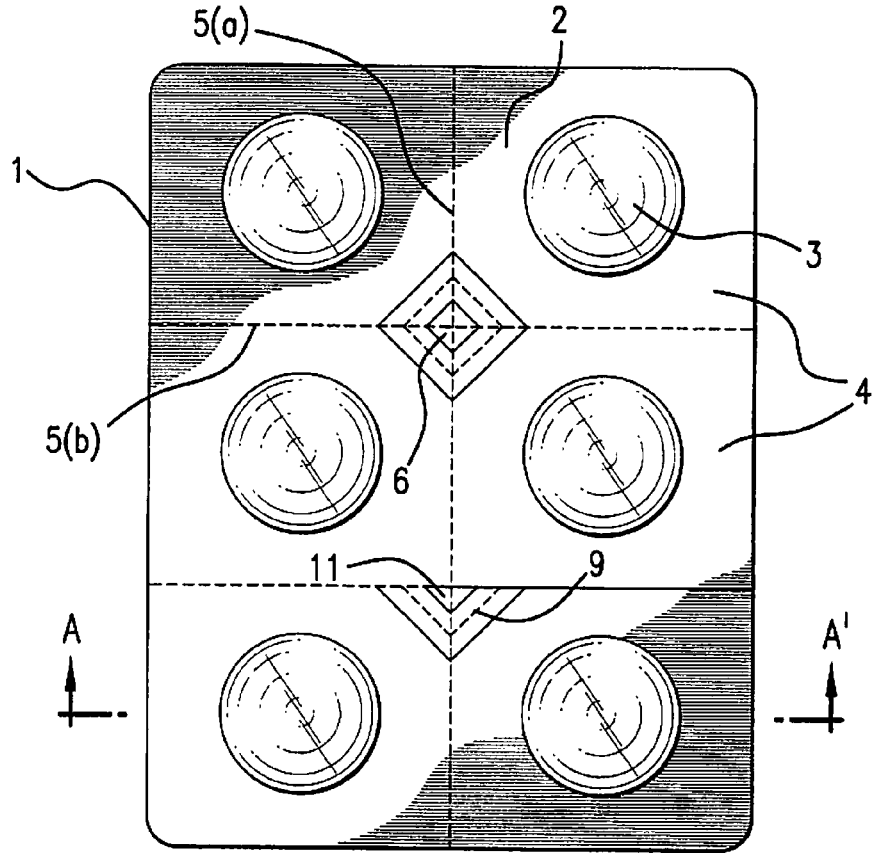
FIG. 1(*a*) is a top plan view illustrating a first embodiment of the invention having six unit package regions arranged as one blister card package.
Figure 1B:
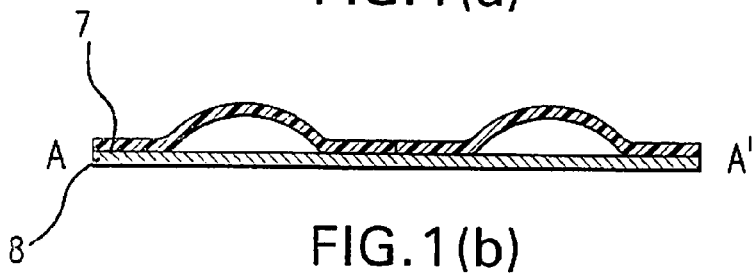
Figure 2A:
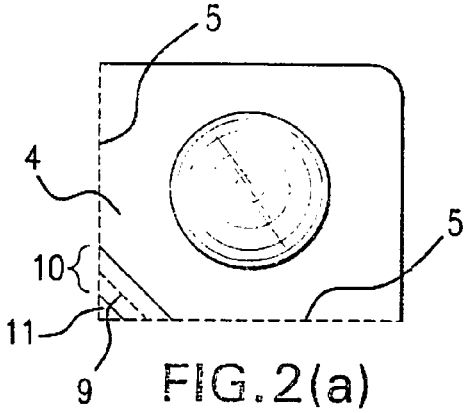
FIG. 2(*a*) is an enlarged top plan view of an individual unit package region detached along the first and second set of lines of weakness from the blister card package shown in FIG. 1(*a*).
Figure 2B:
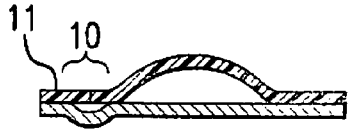
Figure 2C:
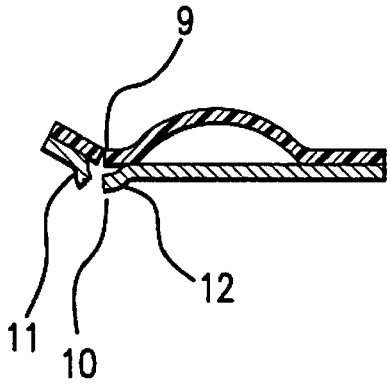
Figure 2D:
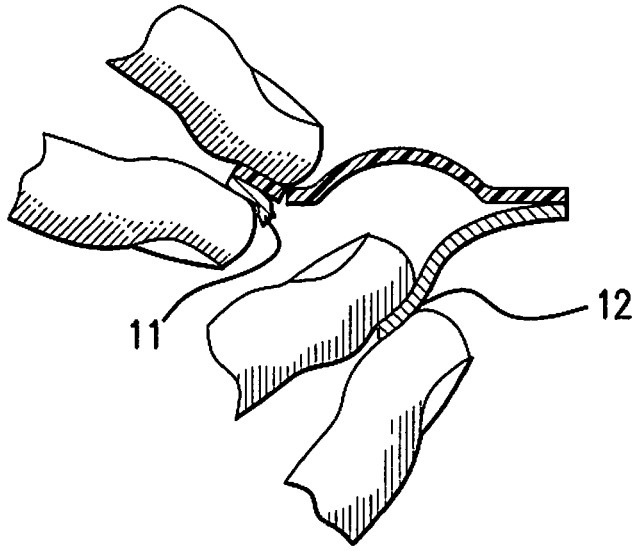

Referring to the drawings, FIG. 1(*a*) shows a first embodiment of a blister card package in accordance with the present invention. The blister card package 1 comprises six unit package regions 2. Each individual unit package region is provided with an area in which to accommodate a product and a surrounding flange 4. This area may consist of a raised cavity 3 or a simple pocket or pouch of any shape in which the product is kept protected from physical damage and moisture. The product may be any type of pharmaceutical formulation dosage form comprising tablets, lyophilized powders, capsules, or the like. Each unit package region is detachable from the package due to a first set of lines of weakness 5(*a*) and a second set of lines 5(*b*) including perforations, running transversely in two directions and intersecting 6 between the individual unit package regions. Said perforations run through all layers of the blister card package.

Referring to FIG. 2(*a*) each section 4 may be detached from the blister card package 1 by bending and tearing along the lines of weakness with perforations 5(*a*) and 5(*b*).

The container sheet 7 and closure or lidding sheet 8 are sealed together substantially entirely from the outer edges of the card to the edges of the cavities. The sealing between layers is accomplished by conventional means such as heat sealing or adhesives, as shown in exaggerated form on FIG. 1(*b*).

Each individual unit package region is provided with a third set of line of weakness 9 that defines an area 10 in which the container sheet 7 and closure sheet 8 are not sealed (also shown in FIG. 2(*b*)). Each individual unit package region is also provided with a triangular corner area 11 in which the container sheet 7 and closure sheet 8 are sealed to provide more protection to the contents of each unit package region.

The container sheet 7 may be made by a variety of transparent or opaque multi-layered material, such as polyvinyl chloride (PVC), polyvinyl dichloride (PVDC), polychlorofripluoroethylene (PCFLE), oriented polyamide (OPA), nylon, aluminum foil, polyethylene, polypropylene, or combinations thereof In a preferred embodiment the container sheet 7 is made by a strong, rigid and opaque multi-layered material, such as a combination of one or more layers of PVC, OPA and aluminum foil, held together by layers of adhesive. The container sheet 7 has a substantial thickness between 150 to 300 microns, more preferably between 200 and 250 microns, to provide protection the contents of the blisters. The cavity of each of the unit package region 3 is integrally formed in the container sheet, and may be of any desired size or configuration, preferably round or oval, depending on the product to be stored. The cavity may have different depths also depending on the product. In a preferred embodiment the cavity forms a blister with a depth of 5 to 15 millimeters.

The closure sheet 8 is preferably a multi-layered laminate of metal foil, generally comprised of polyethylene, OPA, nylon polyesters and aluminum foil. In a preferred embodiment the closure sheet comprises polyester laminates and aluminum foil. The thickness range is between 30 to 100 millimeters, preferably between 30 and 50 millimeters. A paper layer is optional and may allow print to be placed on the blister pack. The multi-layered laminate forming the closure sheet may have two or more layers including the adhesive bond layer between the different components. In a preferred embodiment, the closure sheet has three layer excluding the adhesive bond layers. The external side of the closure sheet may serve as a label, preferably providing a complete label on the back of each individual unit package region. The label may include the name of the medicament, the lot number, the expiration date, and directions for opening the blister card package sections, or other important identifying information. The other side of the closure sheet may have special coating to protect the contents of the cavities from moisture and water. As a whole, the thickness and the composition of both, the container sheet 7 and the closure sheet 8 prevents the product encased in the cavity from being crushed during shipping and also prevents child access to the product by biting or tearing through the container sheet.

To facilitate separation of the closure sheet from the container sheet to permit access to the dosage form contained in the cavity of each individual unit package region, is the unsealed zone 10 (see FIGS. 2(*a*) and 2(*b*)) where the container sheet and closure sheet overlap but are not sealed together. In the preferred embodiment shown, the unsealed zone 10 is linear forming a triangle with the intersection of the lines of weakening 5. In each detached individual unit package region, this leaves an unsealed channel in each corner as shown at FIG. 2(*b*).

In use, an individual unit package region 4 is detached from the blister card package 1 by bending and tearing along the perforations forming the lines of weakness 5(*a*) and 5(*b*). After a package region 4 is detached from the card as shown in FIG. 2(*a*), the corner triangle 11 is bent or flexed up at the third set of lines of weakness 9 (FIG. 2(*c*). This breaks the closure sheet at the lines of weakness 9 and exposes the unsealed zone 10 (see FIG. 2(*c*)) where the container sheet and closure sheet overlap but are not sealed together at a corner of each unit. This exposes a large area of the closure sheet that can be used as a pull tab 12.

By grasping simultaneously the remaining of corner 11 (formed by the container sheet corner still attached to the individual unit package region 4) and the closure sheet pull tab 12, the closure sheet and the container sheet are peeled apart (see FIG. 2(*d*)).

Figure 3:
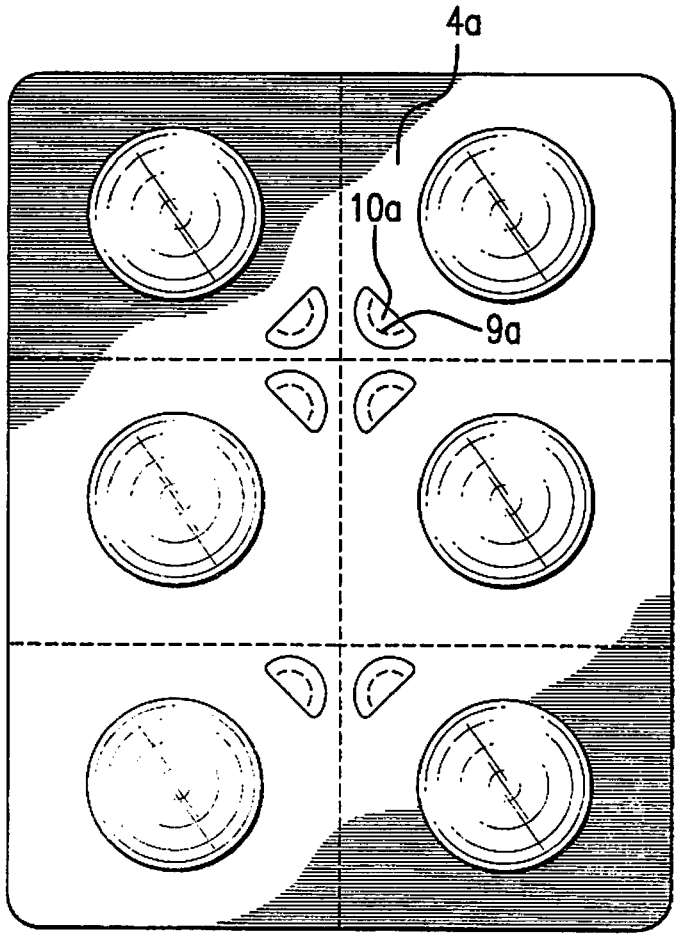
FIG. 3 is a top plan view illustrating a second embodiment of the invention having six individual sections arranged as one blister card package.

A second embodiment of the invention is illustrated in FIG. 3. This embodiment is similar to the first embodiment described above but the third set of weakness lines 9*a* form a semi-circle at the inner corner of each an individual unit package region 4*a*, defining a semicircular unsealed zone 10*a* where the container sheet and closure sheet overlap but are not sealed together.

The above preferred aspects are not limiting and the blister card package can be varied in ways apparent to the skilled artisan reading the foregoing disclosure. For example, the size and shape of the card, the cavities that hold the product, sections of the card, and sealed and unsealed zones are subject to variation. Not every one of the detachable sections need contain a product cavity. The various layers may be modified or added to without departing from the invention as described.

What is claimed is:

1. A child-resistant blister pack defining a plurality of unit package regions wherein each region encloses one unit dosage form, said pack comprising:

a blister film sheet having unit package regions, wherein each unit package region consist of a cavity and a flange surrounding said cavity, each cavity being adapted to receive a unit dosage form, and a lidding sheet sealed to said flanges of the blister film sheet for enclosing a unit dosage form within each unit package region;

said sealed blister sheet and lidding sheet having a first set of lines of weakness extending from side to side of the blister pack, a second set of lines of weakness extending from side to side of the blister pack running transversely in two directions and intersecting with the first lines of weakness, wherein said first and second set of lines of weakness define the inner borders of each unit package region;

said sealed blister sheet and lidding sheet having a third set of lines of weakness at the internal corner area of each unit package region, defining a triangular unsealed area along each of said line of weakness wherein the container sheet and enclosure sheet overlap but are not sealed together, and a sealed area along each of said line of weakness wherein the container sheet and enclosure sheet are sealed together at the internal corner of each unit package region;

whereby, after an individual unit package region is separated, an unsealed area between the blister sheet and lidding sheet is exposed when the third line of weakness is bent, to form a pull tab to detach the lidding sheet.

2. The child-resistant blister pack as claimed in claim 1, wherein the first and second lines of weakness are perpendicular to each other.

3. The child-resistant blister pack as claimed in claim 1, wherein the third set of lines of weakness forms a curve at the internal corner of each unit package region.

4. The child-resistant blister pack as claimed in claim 1, wherein the pack comprises at least four unit package regions.

5. The child-resistant blister pack as claimed in claim 1, wherein each unit package region has a cavity with a depth between 5 and 15 millimeters.

6. The child-resistant blister pack as claimed in claim 1, wherein the blister film sheet is opaque.

7. The child-resistant blister pack as claimed in claim 1, wherein the blister film sheet is transparent.

* * * * *